US007109921B2

(12) United States Patent
Leelaratne

(10) Patent No.: US 7,109,921 B2
(45) Date of Patent: Sep. 19, 2006

(54) HIGH-BANDWIDTH MULTI-BAND ANTENNA

(75) Inventor: Dedimuni Rusiru Vinodaka Leelaratne, Kent (GB)

(73) Assignee: Harada Industries (Europe) Limited, Kent (GB)

( * ) Notice: Subject to any disclaimer, the term of this patent is extended or adjusted under 35 U.S.C. 154(b) by 0 days.

(21) Appl. No.: 10/499,523

(22) PCT Filed: Dec. 19, 2002

(86) PCT No.: PCT/GB02/05782

§ 371 (c)(1),
(2), (4) Date: Feb. 8, 2005

(87) PCT Pub. No.: WO03/052869

PCT Pub. Date: Jun. 26, 2003

(65) Prior Publication Data

US 2005/0140549 A1 Jun. 30, 2005

(30) Foreign Application Priority Data

Dec. 19, 2001 (GB) ..... 0130360.1

(51) Int. Cl.
*H01Q 1/38* (2006.01)

(52) U.S. Cl. ..... 343/700 MS

(58) Field of Classification Search ..... 343/700 MS, 343/846

See application file for complete search history.

(56) References Cited

U.S. PATENT DOCUMENTS 5,748,149 A * 5/1998 Kawahata ..... 343/700 MS
5,760,746 A * 6/1998 Kawahata ..... 343/702
6,133,881 A * 10/2000 Kushihi et al. ..... 343/700 MS
6,300,909 B1 * 10/2001 Tsubaki et al. ..... 343/700 MS
6,469,673 B1 * 10/2002 Kaiponen ..... 343/703
6,614,398 B1 * 9/2003 Kushihi et al. ..... 343/700 MS
6,788,257 B1 * 9/2004 Fang et al. ..... 343/700 MS
6,873,291 B1 * 3/2005 Aoyama et al. ..... 343/700 MS
6,914,565 B1 * 7/2005 Shikata et al. ..... 343/700 MS

FOREIGN PATENT DOCUMENTS

EP 1 067 627 A1 1/2001
EP 1 108 616 A2 6/2001
EP 1 113 524 A2 7/2001

OTHER PUBLICATIONS

Copy of International Search Report dated Apr. 22, 2003.
Rowell et al., "A Compact PIFA Suitable for Dual-Frequency 900/1800-MHz Operation", IEEE Transactions On Antennas and Propagation, IEEE Inc., New York, U.S.A., vol. 46, No. 4, pp. 596-598 (Apr. 1, 1998).

(Continued)

*Primary Examiner*—Tan Ho
(74) *Attorney, Agent, or Firm*—Dickstein Shapiro LLP

(57) ABSTRACT

A high-bandwidth multi-band antenna includes a ground plane member, a first patch member extending in generally-parallel spaced relationship with the ground plane member and electrically connected thereto, and a second patch member connectable to a signal feedline and extending generally coplanar with the first patch member within a slot formed in the first patch member. The second patch member is formed integral with a vertical conductive connecting member as part of a folded conducting plate; this construction allows the second patch member to be quickly and accurately positioned relative to the ground plane member before attachement to the ground plane member. The antenna has the advantages of a high bandwidth, simple construction and inexpensive manufacture.

19 Claims, 22 Drawing Sheets

OTHER PUBLICATIONS

Guo et al., "A Quarter-Wave U-Shaped Patch Antenna with Two Unequal Arms for Wideband and Dual-Frequency Operation", IEEE Transactions on Antennas and Propagation, IEEE Inc., New York, U.S.A., vol. 50, No. 8, pp. 1082-1087 (Apr. 8, 2002).

* cited by examiner

| | |
|---|---|
| L1 | 45.0 |
| L2 | 24.0 |
| X1 | 10.7 |
| X2 | 04.0 |
| X3 | 06.0 |
| X4 | 13.5 |
| Y1 | 05.0 |
| Y2 | 09.0 |
| Y3 | 10.0 |
| Y4 | 10.0 |

HIGH-BANDWIDTH MULTI-BAND ANTENNA

BACKGROUND OF THE INVENTION

This application is a 371 of PCT/GB02/05782 filed on Dec. 19,2002.

The present invention relates to a multi-hand antenna, and more particularly to a high-bandwidth multi-band antenna that is both compact and easy-to-manufacture.

Because of their compactness, ease-of-manufacture and relatively low cost, microstrip antennas have become widely used as vehicle antennas for mobile telephones. Microstrip antennas generally consist of a grounded patch member that extends in parallel spaced relationship with one or more other patch members, with a signal feedline extending to the plane of those other patch members. Many such antennas are designed as dual-band antennas, in which the return loss decreases in two separated frequency bands each used for a different phone system. Although such antennas are already of relatively simple construction, efforts continue to improve them, both by simplifying their design and reducing their manufacturing cost.

SUMMARY OF THE INVENTION

The inventors of the subject invention have found that the bandwidth of a microstrip antenna can be generally increased if the antenna is constructed such that a signal feedline extends into the plane of the other patch members so as to be separated by a slot from one of the other patch members which is electrically connected to the grounded patch member of the antenna.

The inventors have also found a way to further simplify the construction of such microstrip antennas when the further patch members extend in a different plane from the grounded patch member, as is the case with one form of the subject invention. Microstrip antennas of that type are usually constructed by first forming a grounded patch member separately from the one or more further patch members, and then forming an antenna such that all of the patch member are maintained in a generally multi-planar parallel spaced relationship. For final assembly of the antenna, the patch members need to be held in a multi-planar parallel spaced arrangement at an appropriate orientation. It has been found that forming the further patch members so as to have an attached integral spacing means prior to final connection with the grounded patch member allows the further patch members to be more quickly positioned relative to the grounded patch member during final assembly.

In a first aspect, the subject invention is a high-bandwidth multi-band antenna that includes: a grounded patch member, a further patch member extending in generally-parallel spaced relationship with the grounded patch member and being electrically connected thereto by a radiating element, and a feedline capacitively coupled to the further patch member.

In a second aspect, the subject invention is a high-bandwidth multi-band antenna, including: a grounded patch member, a further patch member extending in generally-parallel spaced relationship with the grounded patch member and being electrically connected thereto, and a feed means adapted to carry a feedline signal. The feed means terminates generally coplanar with the further patch member and occupies a part of a void space in the further patch member, a slot being thereby defined between the further patch member and the termination. The further patch member and the termination are capacitively coupled across the slot.

In a first form of the second aspect of the invention, the teed means may be a feed patch member, with the dimensions of the feed patch member and the width of the slot being selected such that each is within a respective range in which the bandwidth of the antenna varies with the slot width. In a second form of the second aspect of the invention, the antenna may also include a discrete capacitor connected between the feed means and the further patch member, wherein the antenna bandwidth varies with the capacitive value of the discrete capacitor. In this second form of the second aspect of the invention, the feed means may be an end portion of a feedline carrying the feedline signal.

In the first and second forms of the second aspect of the invention, the further patch member may be electrically connected to the grounded patch member by a radiating element extending between the grounded patch member and one first edge of the further patch member, and more preferably a first edge of the radiating element may be connected to the one first edge of the further patch member. The whole first edge of the radiating element may be connected to the whole one first edge of the further patch member such that the connecting edges are coextensive, or alternatively, the whole first edge of the radiating element may be connected to only a portion of the one first edge of the further patch member, and in such case, the feed means may extend inwardly from an unconnected portion of the one first edge of the further patch member.

In one form, the further patch member and the radiating element may be integrally formed from a conductive sheet, and separated by a fold-line in the sheet. In this form, the radiating element preferably extends generally normal to the further patch member, and more preferably, the radiating element is generally-planar; even more preferably, this form also includes a solid dielectric material extending in the space that separates the grounded patch member from the further patch member and the feed means. In another form, the further patch member, the radiating element and the grounded patch member may be integrally-connected parts of a generally-planar conductive sheet.

In the first form of the second aspect of the invention, the grounded patch member, the further patch member and the feed patch member may be each formed as a conductive surface on a dielectric support. In this form of the invention, the further patch member and feed patch member may both have a rectangular shape with longer first edges of each being oriented in the same direction. The length and width of the further patch member may be approximately five times the respective length and width of the feed patch member. Also in this form of the invention, a frequency bandwidth for a higher one of the resonant frequencies of the antenna may increase with a reduction in the length of the further patch member. A lowest resonant frequency of the antenna may decrease with a reduction in the length of the further patch member.

The resonant frequencies of the antenna may increase with an increase in the width of the radiating element. The radiating element may be approximately 25 mm wide. A decrease in height of the radiating element may result in an increase in the resonant frequencies of the antenna.

The further patch member may be approximately 45 mm long and 24 mm wide, and in such case the feed patch member is preferably approximately 9 mm long and 5 mm wide. More preferably, a slot formed between the further patch member and feed patch member has a width between approximately 0.5 mm and approximately 1 mm.

The radiating element may include a series of parallel strips, each strip extending between the grounded patch member and the one first edge of the further patch member.

Preferably, the antenna operates, in a first band in the range of 900 MHz and in a second band in the range of 1800 MHz. More preferably, it also operates in a third band in the range of 2100 MHz.

In the first form of the second aspect of the invention, the antenna may also include a radiating element connecting a portion of an edge of the grounded patch member to a portion of an edge of the further patch member such that the grounded patch member, radiating element and further patch member form a generally U-shaped configuration. The grounded patch member, further patch member, feed patch member and radiating element all extend in the same plane.

Preferably, the antenna may also include a feedline patch member connected to the feed patch member. The feedline patch member extends generally parallel to the radiating element and toward the grounded patch member in the plane of the further patch member, feed patch member and radiating element. More preferably, the grounded patch member, further patch member feed patch member, feedline patch member and radiating element are each formed as a conductive surface on a dielectric support. Even more preferably, the dielectric support is formed from one of FR4, polyester film, glass and duroid.

The word 'radiating' in the term 'radiating element' is not intended to denote an antenna that is only in a transmitting state, but rather is used to describe that this portion ('the radiating element') of the antenna is active whenever the antenna is active, i.e. during reception as well as transmission.

BRIEF DESCRIPTION OF THE DRAWINGS

Preferred features of the present invention will now be described, by way of example only, with reference to the accompanying drawings, in which.

DETAILED DESCRIPTION OF THE INVENTION

The antenna of the invention is designed to operate over two or three frequency bands. One example of its use would be in a multi-band telephone antenna to cover the bands: 890 to 960 MHz, 1710 to 1880 MHz, and 1920 to 2175 MHz. The upper two of these three bands could be combined into a very wide single band. Being compact and inexpensive to manufacture, this antenna is equally useful for other communication applications.

Figure 1:
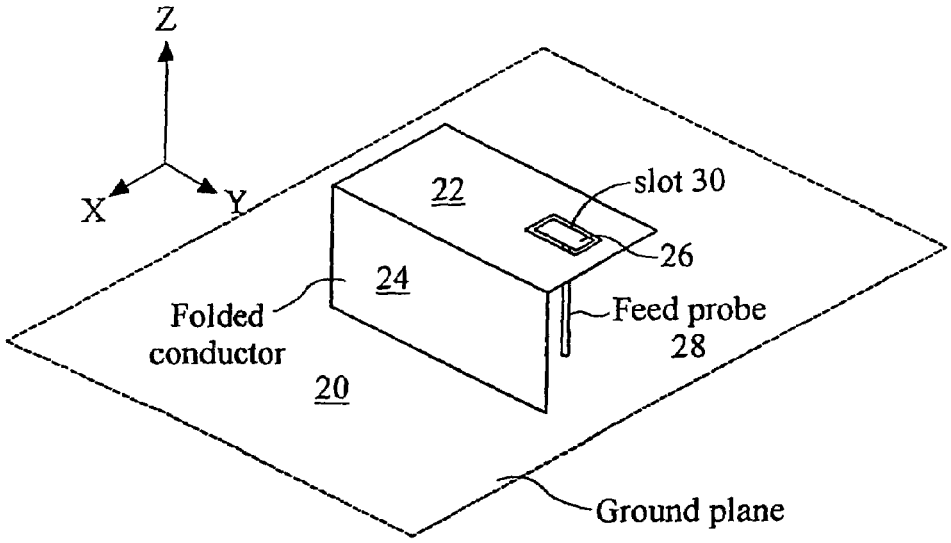
FIG. 1 is a perspective view of a first embodiment of the antenna of the subject invention.

As illustrated in FIG. 1, the antenna of the first embodiment has a grounded patch member 20 which is secured to a folded conductor that includes a further patch member 22 extending substantially parallel to grounded patch member 20 and also includes a radiating element 24. The further patch member 22 has an aperture within which is positioned a feed patch member 26 that is connected to a feed probe 28. The feed probe 28 is normally an extension of the center feedline of a coaxial cable (not shown) having its groundline connected to grounded patch member 20.

The antenna may be constructed such that the further patch member 22 and the feed patch member 26 remain as a single piece of material while the folded conductor is attached to grounded patch member 20 and feed probe 28, and such that after the attachment a slot 30 is cut around the feed probe 28 to define separated further and feed patch members. It is the capacitance that results from presence of the slot that increases the bandwidth of the antenna.

Figure 11:
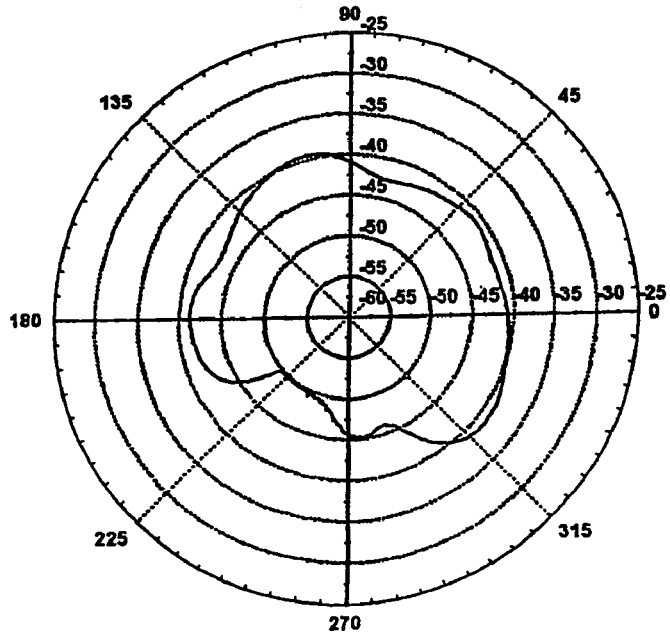
FIG. 11 illustrates the vertical-polarisation radiation pattern formed in the polar elevation YZ plane of the antenna of FIG. 1.
Figure 13:
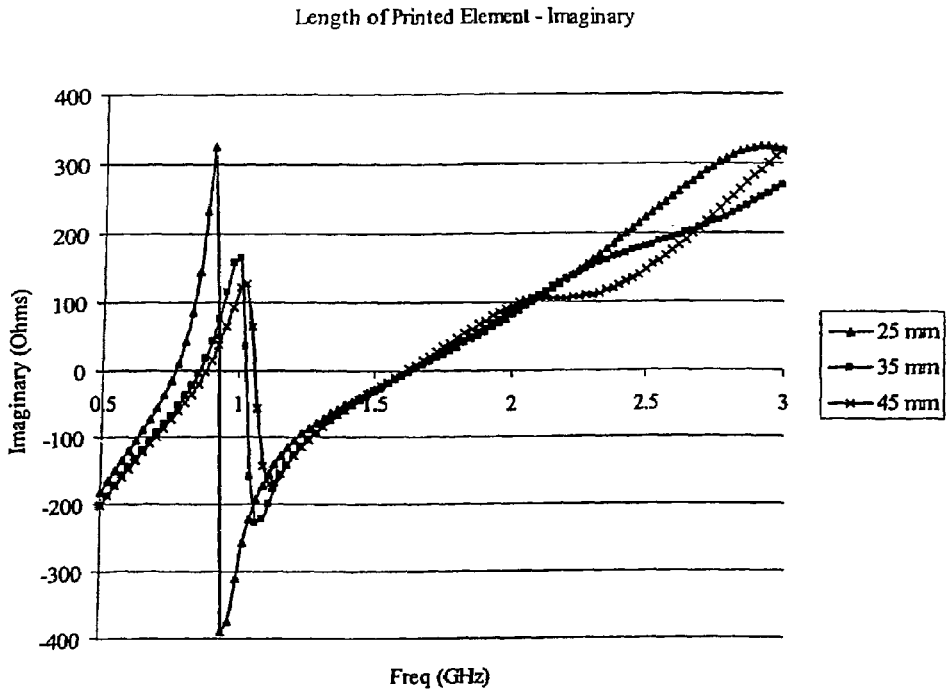
FIG. 13 is a graph illustrating variation in imaginary impedance with frequency for variation in the length of the further patch member in the parametric study.
Figure 12:
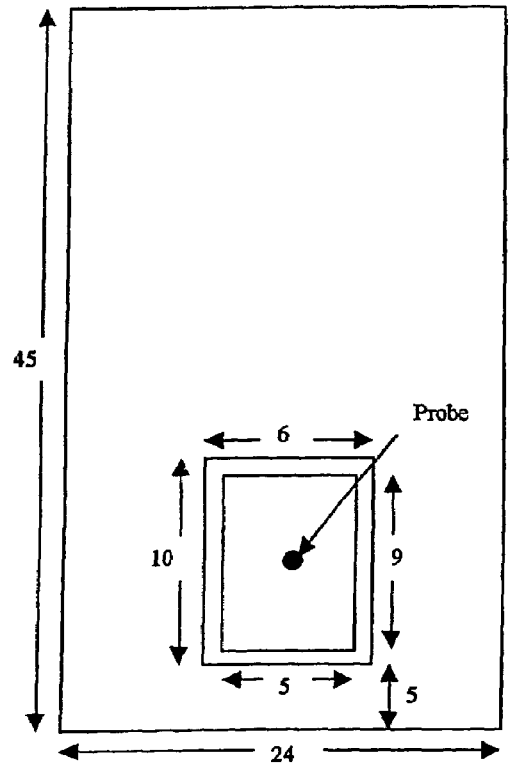
FIG. 12 is a schematic plan view of the further and feed patch members of an antenna of the second embodiment that was used in a parametric study, the view indicating the dimensions (in millimetres) of the first and second patch members.

Also illustrated in FIG. 1 are X, Y and Z axes that are used with FIGS. 11, 12 and 13 to describe radiation patterns formed on the antenna.

Figure 2:
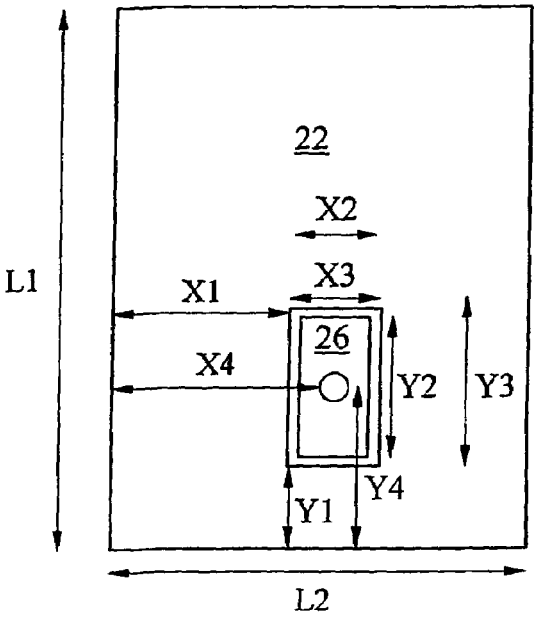
FIG. 2 is a plan view of the antenna of FIG. 1.

Dimensions (in millimetres) of a typical example of the further and feed patch members are shown in FIG. 2. In this example, further patch member 22 is 45 mm long and 24 mm wide, whereas feed patch member 26 is 9 mm long and 4 mm wide. Those portions of the slot 30 extending parallel to the length dimension of the patch members are 1 mm wide, while those portions of the slot 30 extending parallel to the width dimension of the patch members are 0.5 mm wide.

Figure 3:
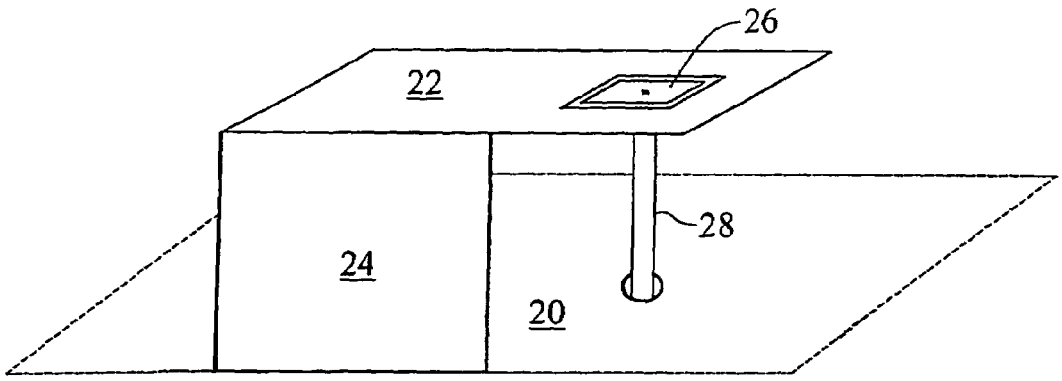
FIG. 3 is a perspective view of a second embodiment of the antenna of the subject invention.

A second embodiment of the antenna, having a radiating element 24 not as wide as the length of the further patch member 22, is shown in FIG. 3. Adjusting the dimensions of the radiating element 24 in this configuration allows both the frequency and bandwidth of the antenna to be adjusted. The first and second embodiments exhibit, in general, wide-band characteristics. There are two resonances, the higher one being sufficient to provide coverage that extends over both the PCN and UMTS bands (1710 to 2175 MHz).

Figure 4:
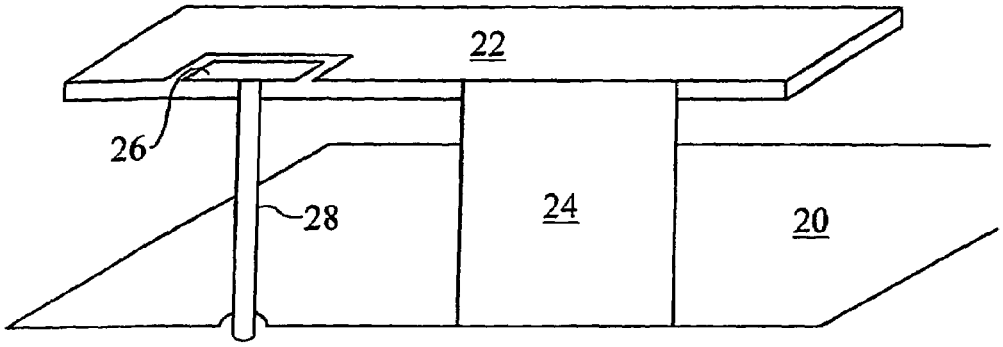
FIG. 4 is a perspective view of a third embodiment of the antenna of the subject invention.

FIG. 4 illustrates a third embodiment of the antenna. The feed patch member 26 is positioned such that one of its longer edges extends in-line with one of the longer edges of the further patch member 22 on one portion of feed patch member 26. A radiating element 24 extends between the grounded patch member 20 and the further patch member 26 on another portion of further patch member 26. A feed pin 28 connects to feed patch member 26.

Figure 5:
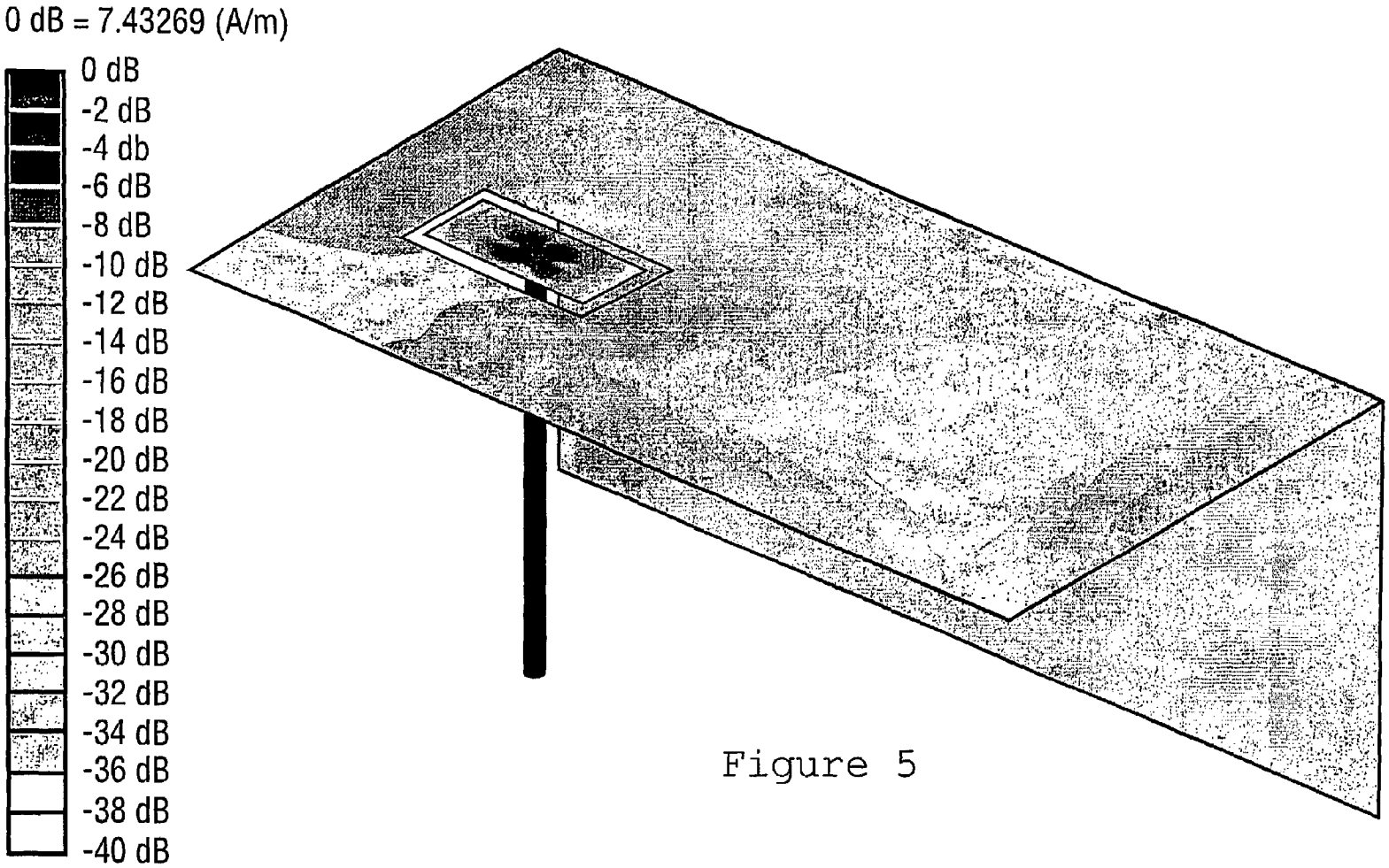
FIG. 5 illustrates a typical surface current distribution pattern for the antenna of FIG. 1.
Figure 6:
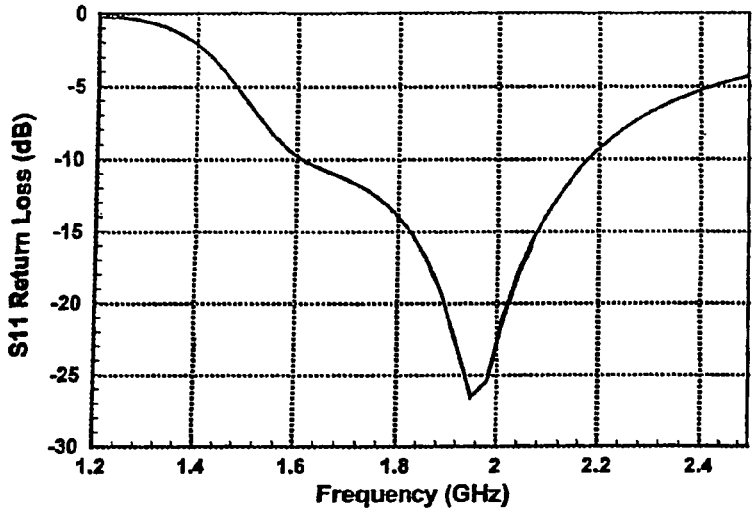
FIG. 6 is a graph illustrating the S11 return loss versus frequency for the antenna of FIG. 1.
Figure 7:
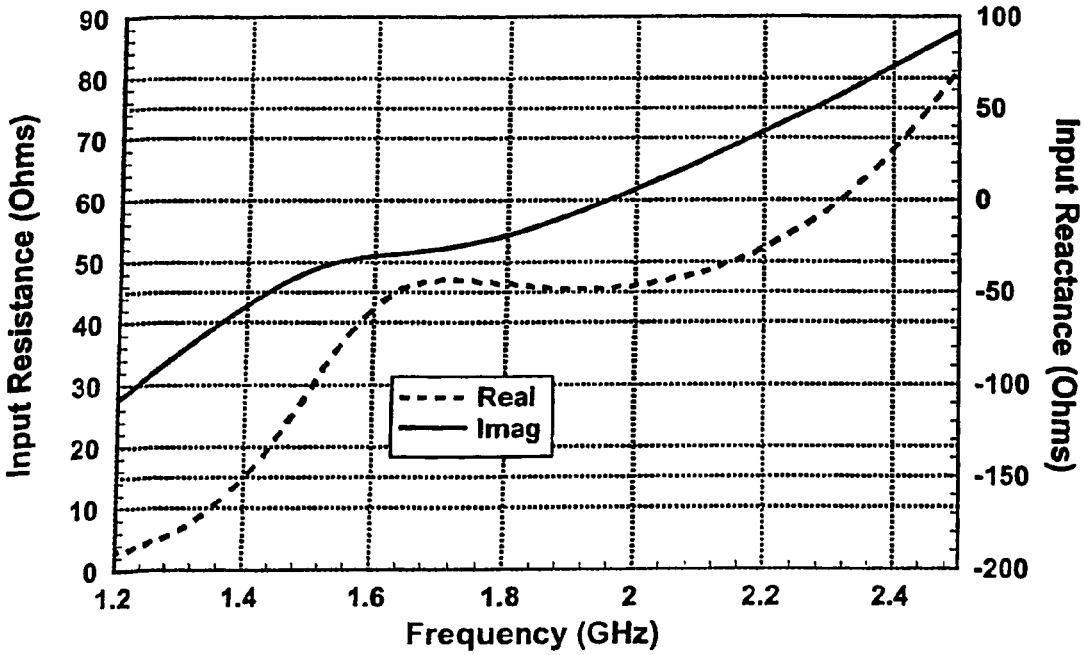
FIG. 7 in a graph illustrating the input resistance and impedance versus frequency for the antenna at FIG. 1.

FIG. 5 illustrates a typical surface current distribution for the first embodiment of the antenna, and was created using a software simulation performed for the higher, i.e. 1900 MHz and above, frequency bands. For this simulation, the height H of the further and feed patch members above the grounded patch member was set at 16 mm. The surface current distribution in FIG. 5 indicates that the feed probe was heavily excited, while the plate structure carried very low currents. This indicates that the probe was responsible for radiation from the antenna. FIG. 6 plots the return loss of the antenna, while FIG. 7 plots the simulated real and imaginary impedance of the antenna over the same frequency range. From these plots, it can be seen that the bandwidth, defined for a return loss of better than −10 dB is (2.17 GHz−1.61 GHz)=560 MHz. This is equivalent to a "percentage bandwidth" of 29.5%, based on the calculation: $(2.17-1.61)/\{(2.17+1.61)/2\}$. The real part of the impedance is close to 50 ohms over that bandwidth, which makes it easy to match the antenna to a communication system.

Figure 8:
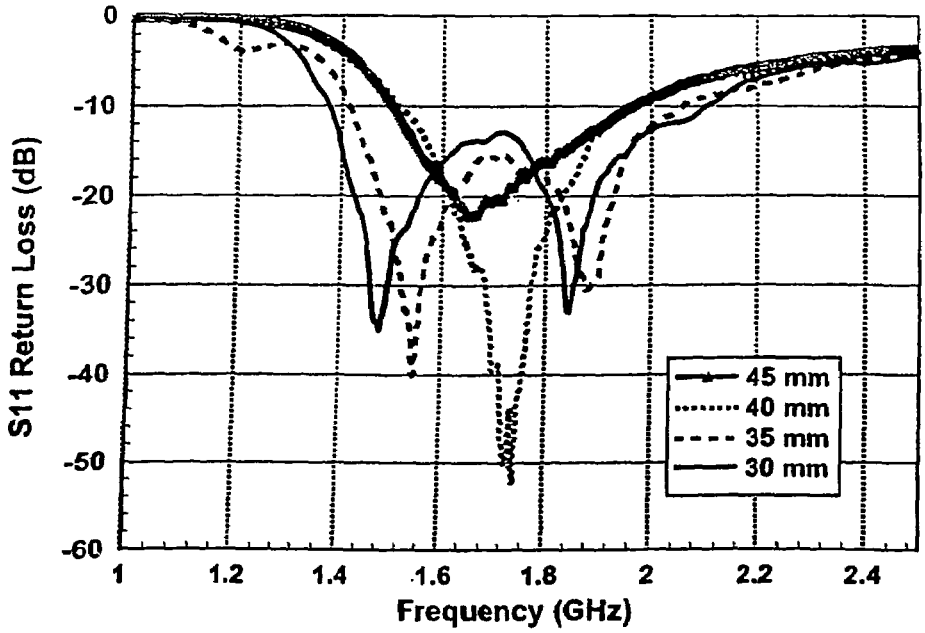
FIG. 8 is a graph illustrating variation in the S11 return loss with frequency for variation in the length of the first patch member of the first embodiment of the antenna.

Four antennas, differing only in the length of the further patch member, were built for experimental measurement. FIG. 8 is a plot of the S11 return loss versus frequency for the four antennas. As the further patch member decreases in length from 45 mm to 30 mm, the bandwidth increases correspondingly. The maximum bandwidth, which was (2105 MHz−1375 MHz)=730 MHz, i.e. percentage bandwidth of 42%, was associated with a further patch member length of 30 mm.

Figure 9:
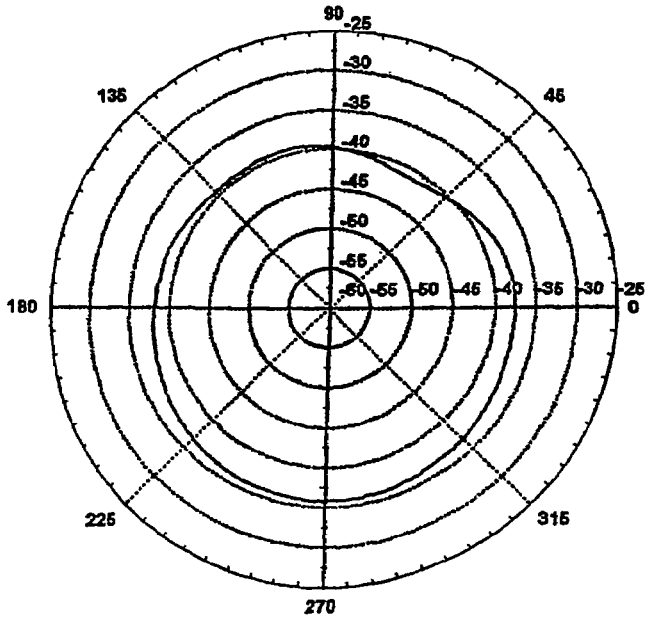
FIG. 9 illustrates the vertical-polarisation radiation pattern formed in the polar azimuth XY plane of the antenna of FIG. 1.
Figure 10:
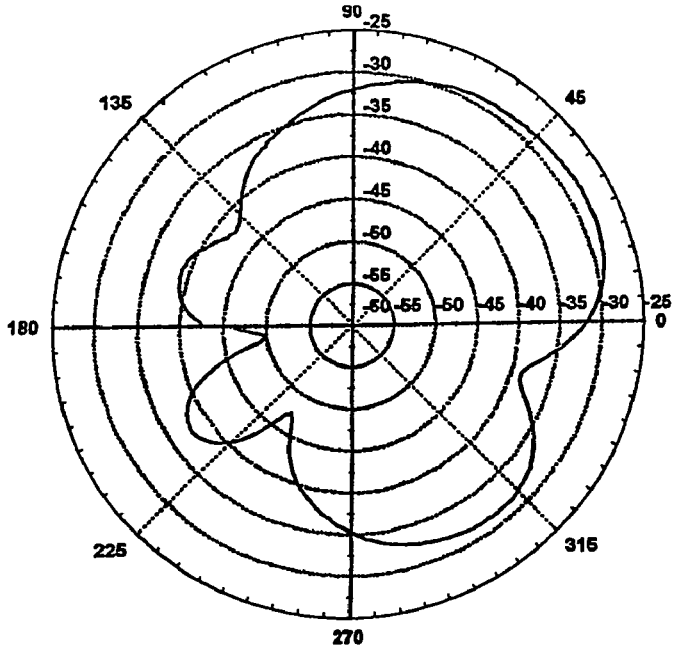
FIG. 10 illustrates the vertical-polarisation radiation pattern formed in the polar elevation XZ plane of the antenna of FIG. 1.

FIGS. 9, 10 and 11 are vertical polarisation plots of the measured radiation patterns in the respective polar azimuth XY plane, polar elevation XZ plane, and polar elevation YZ plane for the antenna of the first embodiment. These radiation patterns show good all-round coverage in the XY plane.

A parametric study was performed using the second embodiment of the antenna, having further and feed patch members with the dimensions (in millimetres) shown in FIG. 12. The length of the further patch member was initially 45 mm, but was varied during the study. A radiation element 16 mm high and 25 mm wide was initially used, but both height and width were varied during the study. The probe had a radius of 0.6 mm and a length corresponding to the height of the radiating element. The further and feed patch members were constructed as printed elements on a FR4 substrate having a thickness of 0.8 mm.

The parametric study involved varying in turn: (i) the length of the further patch member, (ii) the height of the feed pin and radiating element, and (iii) the width of the radiating element, while maintaining the other parameters unchanged.

Figure 14:
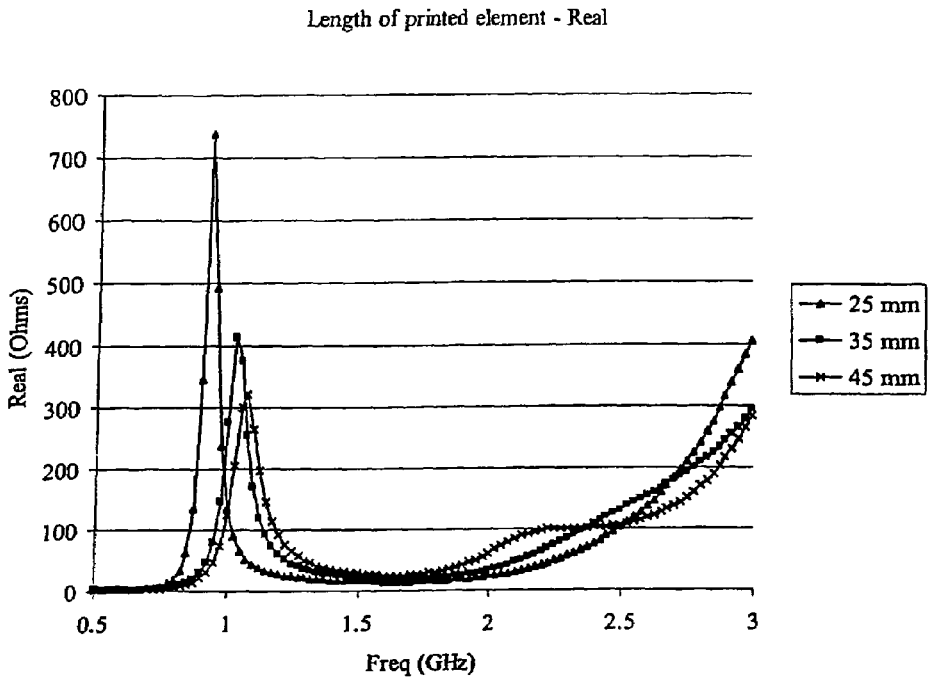
FIG. 14 is a graph illustrating variation in real impedance with frequency for variation in the length of the further patch member in the parametric study.
Figure 15:
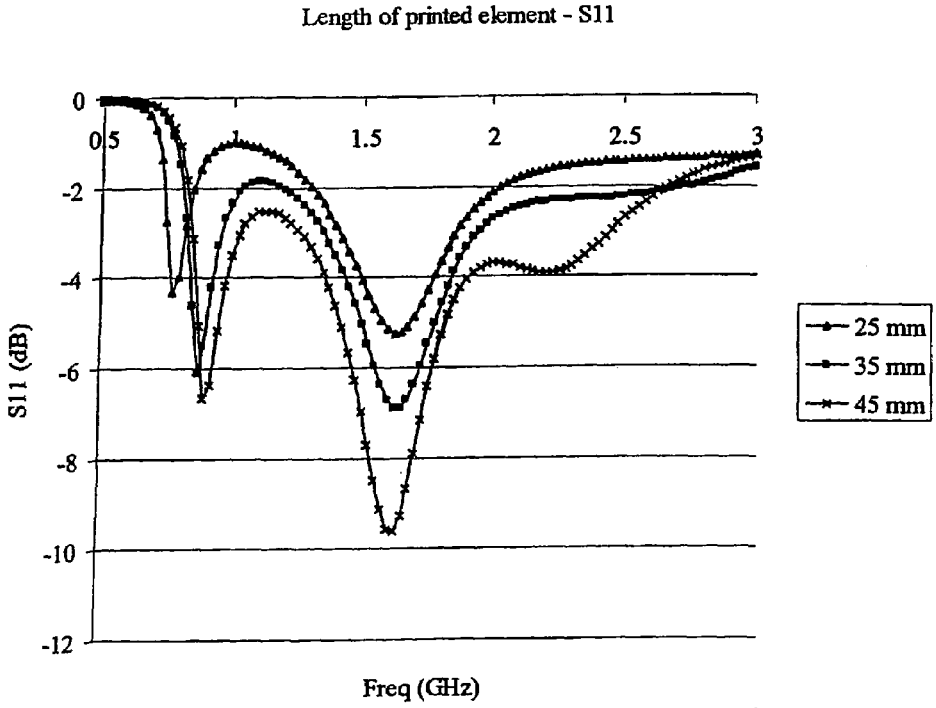
FIG. 15 is a graph illustrating variation in the S11 return loss with frequency for variation in the length of the further patch member in the parametric study.

With respect to the length of the further patch member in the parametric study, FIGS. 13 and 14 illustrate respective variation of the imaginary and real impedance with frequency as the length of the further patch member reduces from 45 mm to 35 mm and then to 25 mm. Reducing the patch length increased the lower resonant frequency slightly, from 800 MHz for 25 mm to 970 MHz for 45 mm, but at the higher band the resonant frequency remained nearly constant. FIG. 15 illustrates the change in S11 return loss with frequency for the three lengths of the further patch member.

Figure 16:
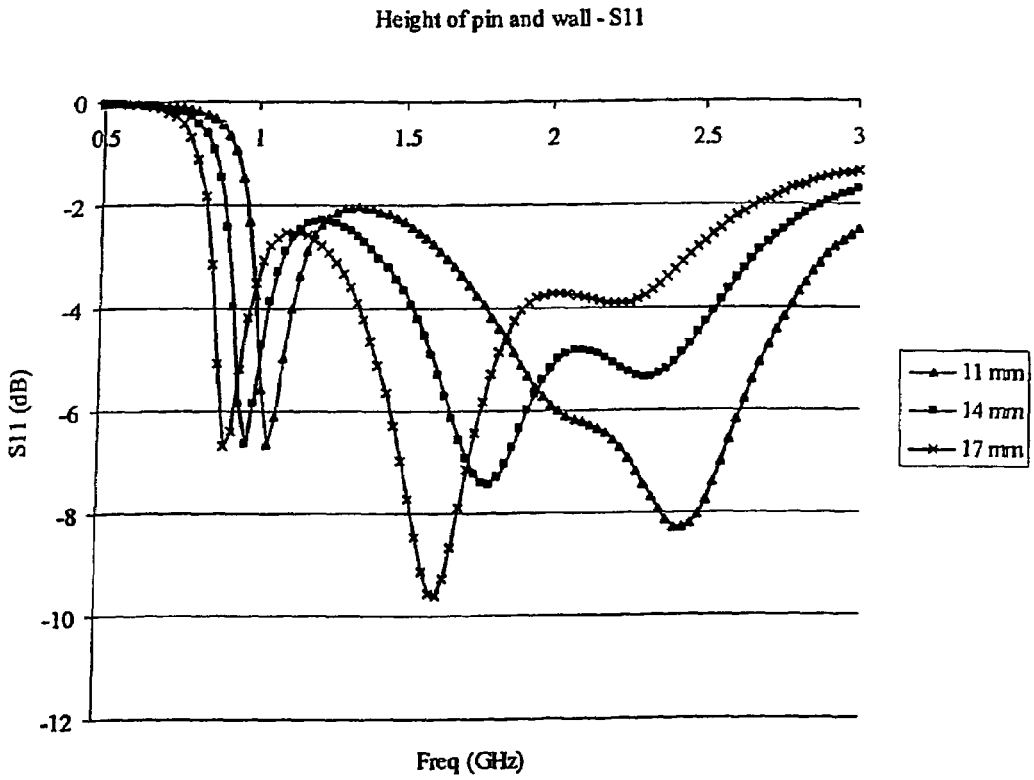
FIG. 16 is a graph illustrating variation in the S11 return loss with frequency for variation in the height of the radiating element and the length of the signal feedline between the grounded patch member and the further patch member in the parametric study.

The effect of varying the height of the radiating element and length of the feed probe is plotted in FIG. 16 for a 50-ohm match impedance. In these measurements, the width of the radiating element was maintained at 25 mm, and the length of the further patch member was maintained at 45 mm. The height has a considerable impact on the resonances at both frequency bands. Resonant frequency increases at both bands as the length of the feed probe reduces. The longer the probe length, the lower the frequency.

Figure 17:
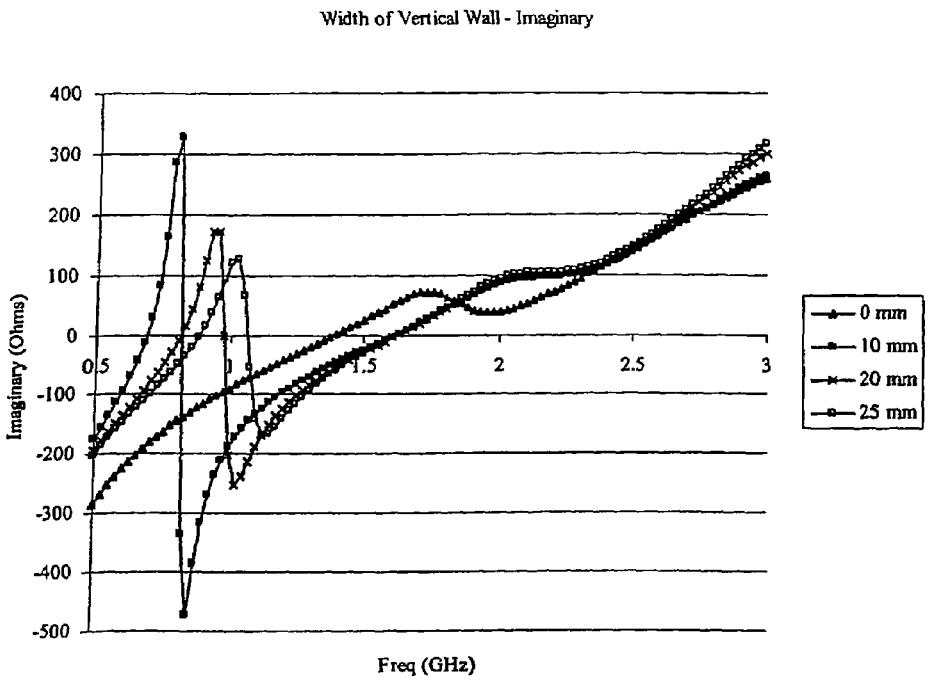
FIG. 17 is a graph illustrating variation in imaginary impedance with frequency for variation in the width of the radiating element in the parametric study.
Figure 18:
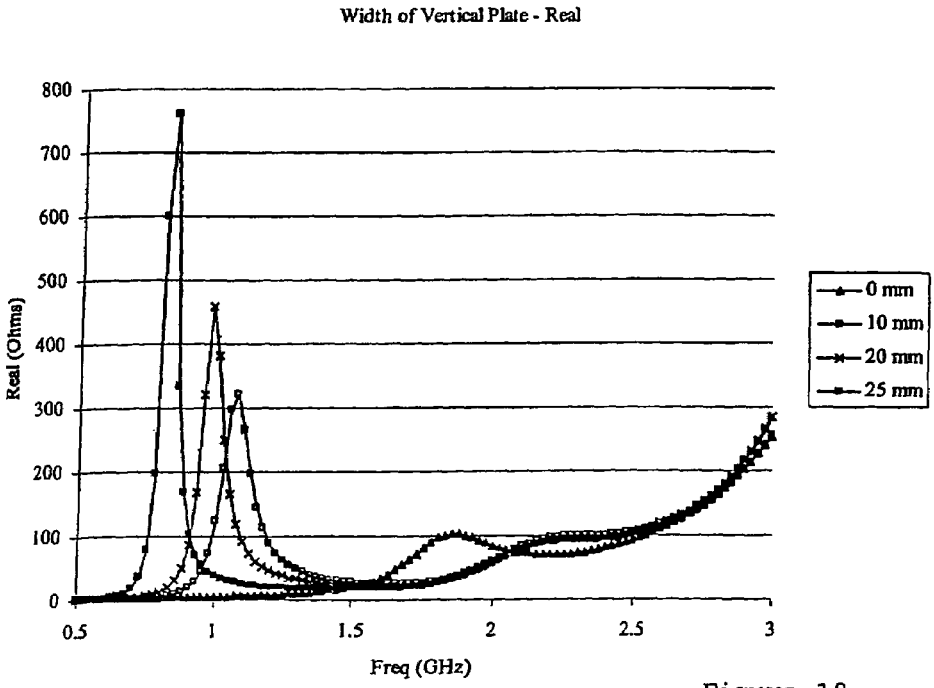
FIG. 18 is a graph illustrating variation in real impedance with frequency for variation in the width of the radiating element in the parametric study.

The effect of varying the width of the radiating element is shown in FIGS. 17 and 18, which respectively illustrate the imaginary and real impedance of the antenna versus frequency for four radiating element widths. In these measurements, the height of the radiating element was maintained at 14 mm, and the length of the further patch member was; maintained at 45 mm. It was found that as the width of the radiating element was increased from 0 mm to 10 mm, then to 20 mm, and then to 25 mm, the resonant frequency of the lower band increased. The resonant frequency of the upper band remained relatively unchanged. A preferred real and imaginary match was obtained for both bands when the width of the radiating element was 25 mm; real and imaginary match becomes better for the lower band as the radiating element is widened, but becomes worse for the higher band. An appropriate compromise is obtained at a radiating element width of approximately 25 mm.

Figure 19:
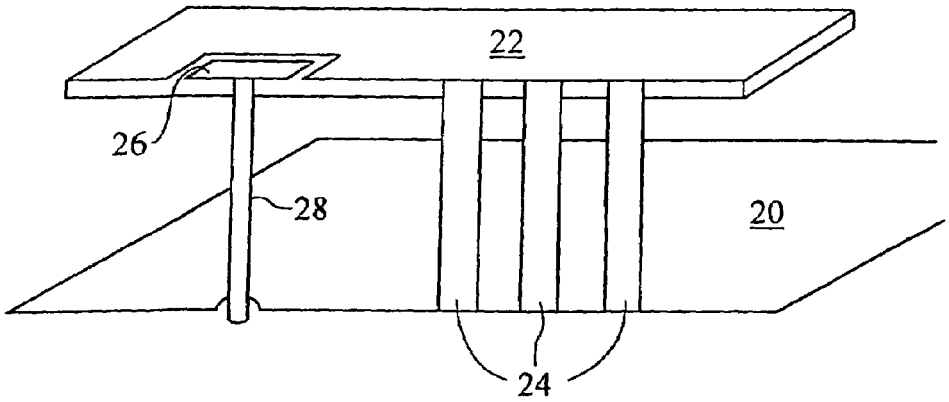
FIG. 19 is a perspective view of a fourth embodiment of the antenna of the subject invention, the fourth embodiment being the same as the third embodiment except for the radiating element being formed by a series of strips.

FIG. 19 illustrates an antenna similar to that in the embodiment of FIG. 4, except that the radiating element 24 is formed by a set of parallel strips rather than a single piece of material. Regarding the parametric study mentioned above, varying the width of the radiating element formed of parallel strips produced approximately the same results as those shown in FIGS. 17 and 18 for the unitary radiating element. With respect to the radiating element formed of strips, references to 'width' means the distance separating outer edges of the outermost strips and includes the width of gaps between the strips.

Figure 20:
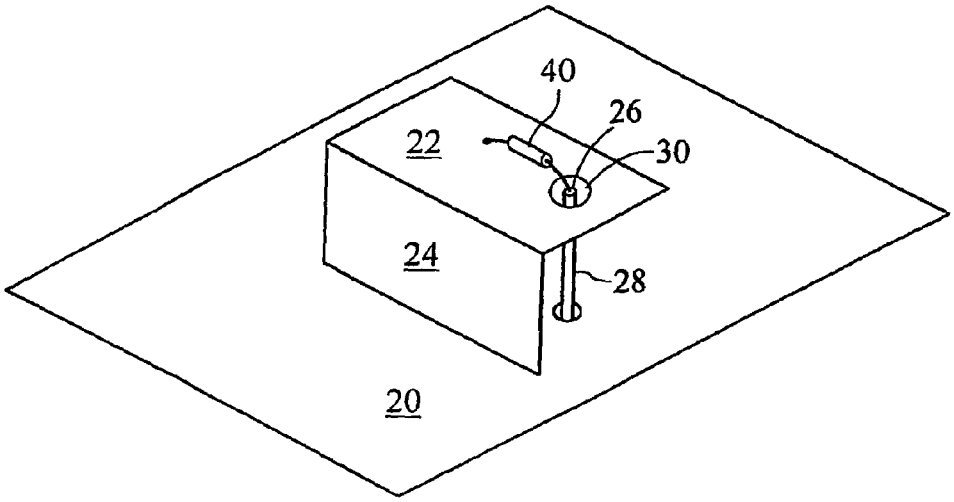
FIG. 20 is a perspective view of a fifth embodiment of the antenna of the subject invention, this embodiment using a discrete capacitor.

FIG. 20 illustrates a fifth embodiment of the subject invention. In this embodiment, the feed patch member 26 is defined by the end of feed probe 28. A capacitor 40 is connected between the end of the feed probe 28 and further patch member 22. In this embodiment, the bandwidth of the antenna is determined by the size of the capacitor.

Figure 21:
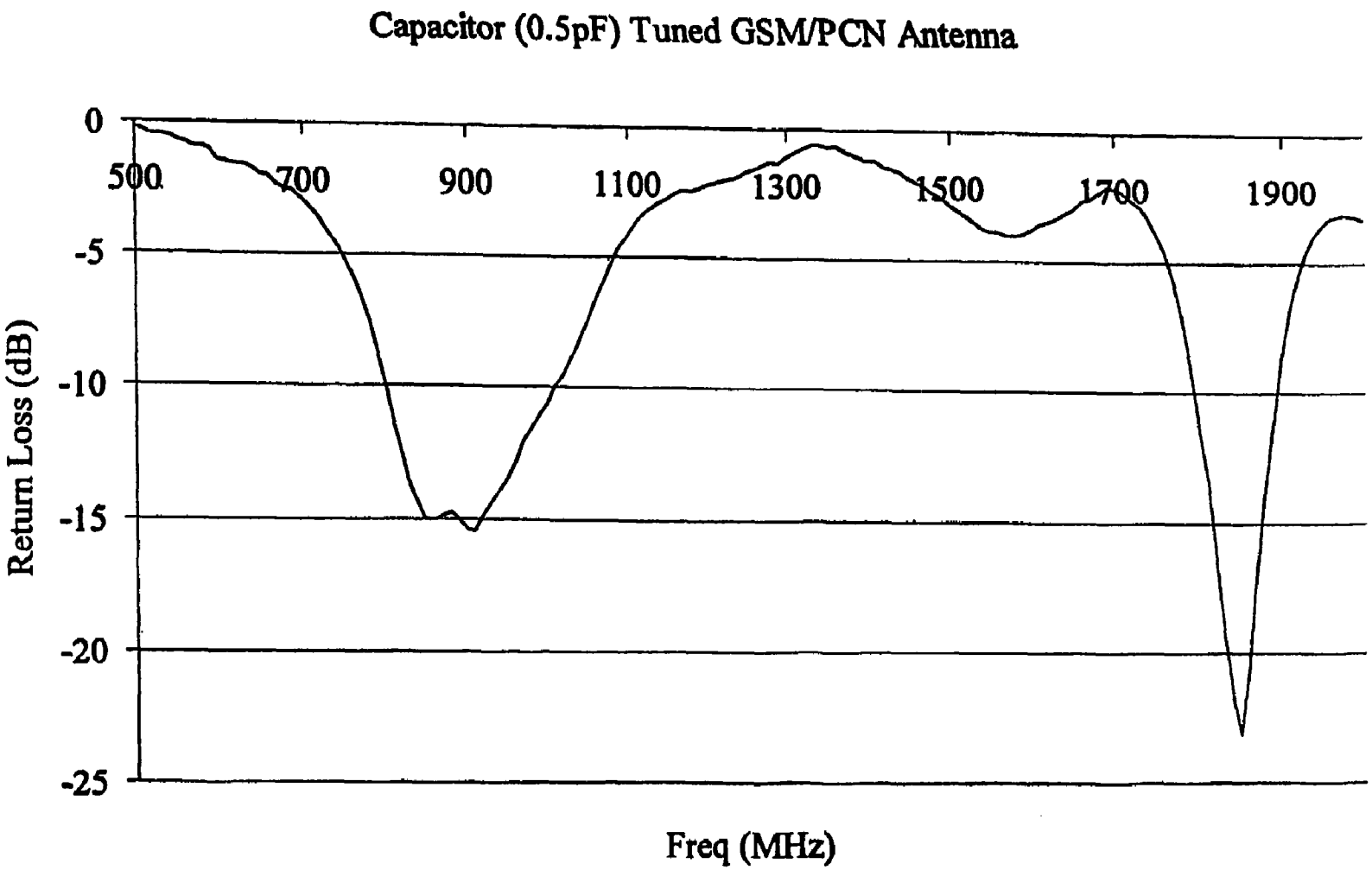
FIG. 21 is a graph illustrating variation in the return loss with frequency for the fifth embodiment of the antenna.

FIG. 21 is a graph of the return loss (measured in dB) versus frequency for an antenna of the fifth embodiment when the capacitor 40 has a value of 0.5 pF.

Figure 22:
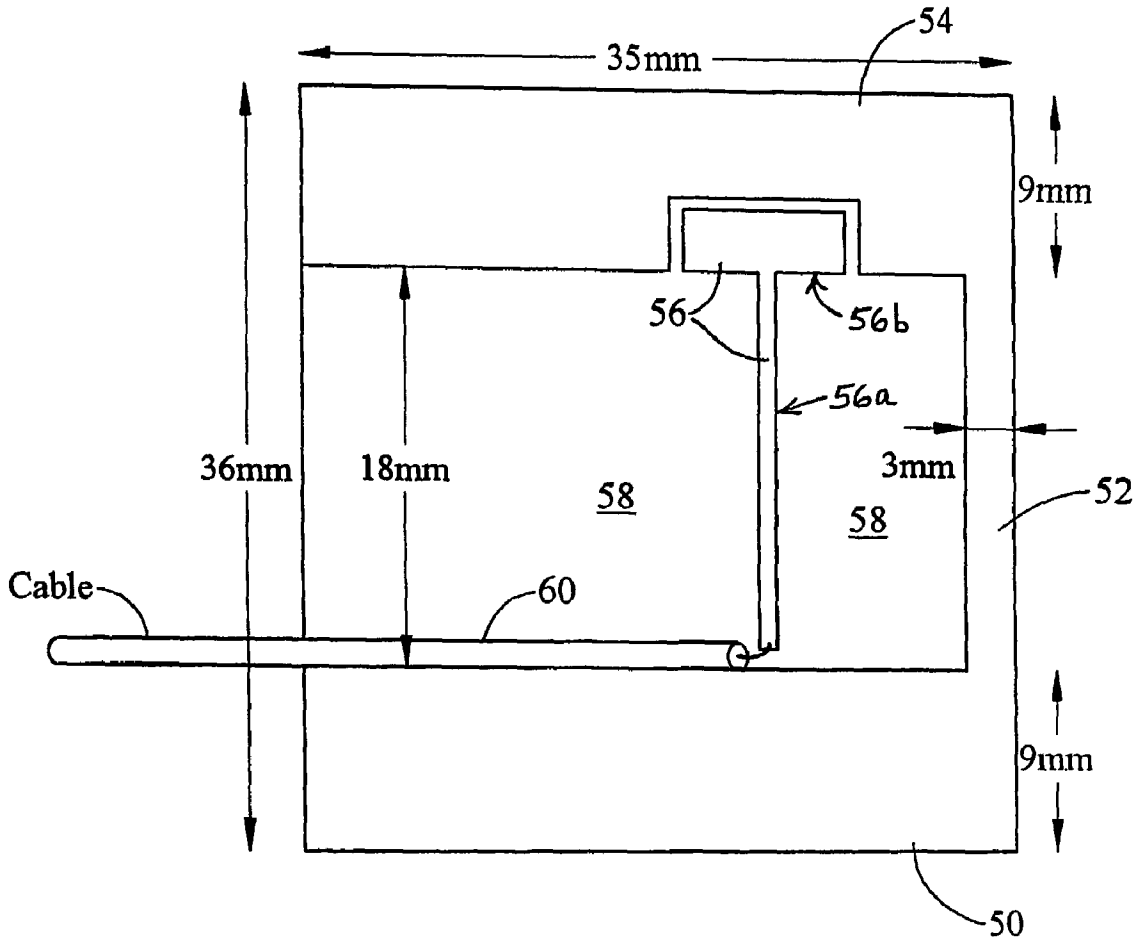
FIG. 22 is a plan view of a sixth embodiment of the antenna of the subject invention, this embodiment showing an antenna in which the grounded patch member, further patch member and feed patch member are all coplanar.
Figure 23:
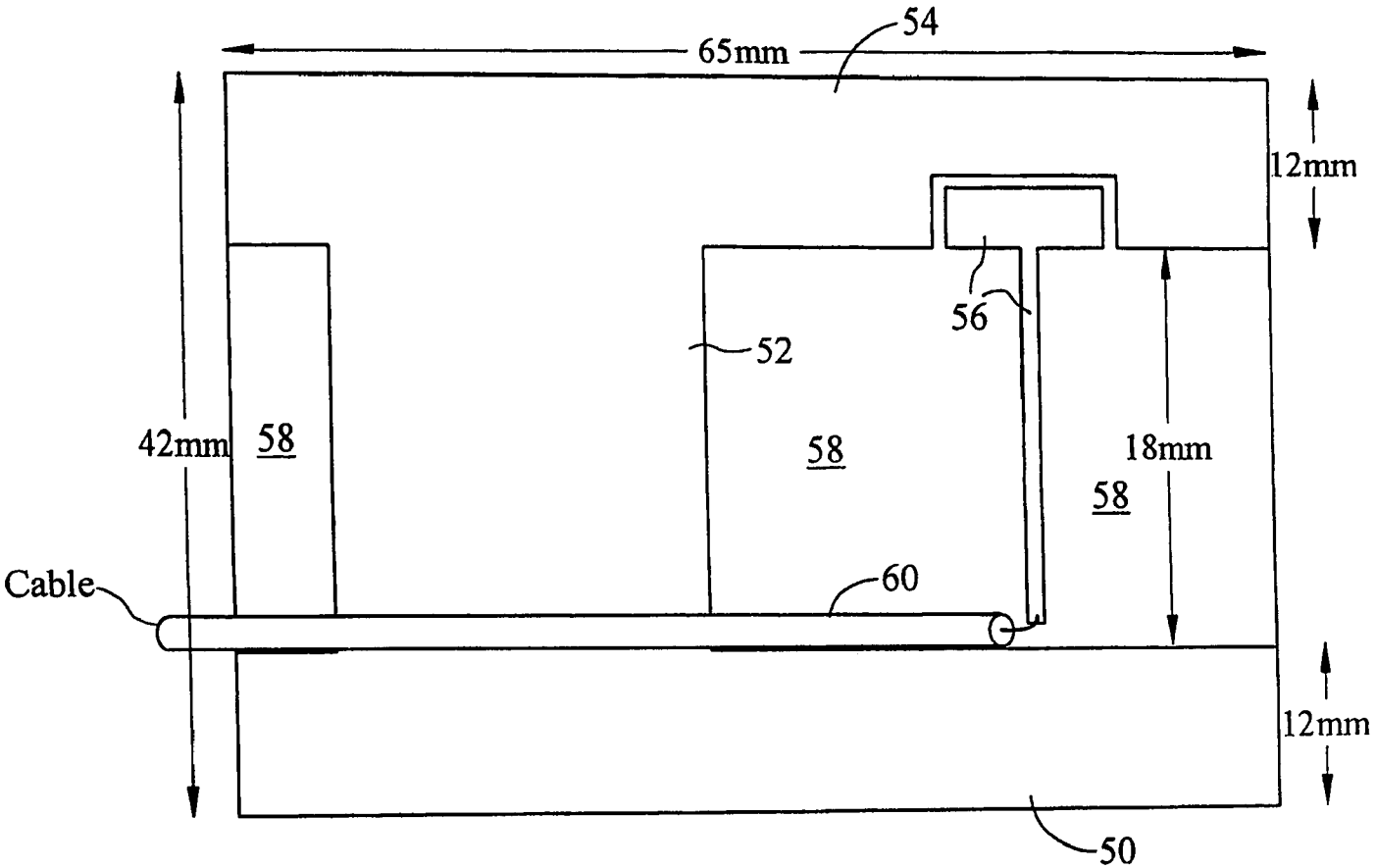
FIG. 23 is a plan view of a seventh embodiment of the invention, this embodiment being the same as the sixth embodiment except for the location of the radiating element between the grounded patch member and the further patch member.

FIGS. 22 and 23 illustrate two variations of an alternative form of the invention in which a grounded patch member, further patch member and feed patch member all extend in the same plane. This form of the invention is particularly suited to construction by etching a conductive surface on a dielectric support. As shown in FIGS. 22 and 23, a grounded patch member 50, a radiating element 52, a further patch member 54 and a feed patch member 56 are all formed by etching a conductive surface of a dielectric support 58. A grounded portion of a coaxial cable 60 which is adapted to carry a feed signal is soldered to the grounded patch member 50, and the feedline of the coaxial cable 60 is soldered to the end of the tail of the feed patch member 56. Sample dimensions are also shown (in millimetres) on FIGS. 22 and 23.

Referring again to FIG. 22, the dielectric support 58 may be formed from any suitable non-conductive material, and FR4, polyester film, glass and duroid are usable. Depending on the material used for the dielectric support, some minor retuning of the radiating element 52 and the tail 56*a* of the feed patch member 56 may be required (the "tail" is the elongated portion of feed patch member 56 that extends parallel to the radiating element 52 in FIG. 22). The feed patch member tail 56*a* and the radiating element 52, both of which are formed by etching of conductive material on the surface of the non-conductive support 58 or by printing onto the dielectric material of that support, are the main radiating elements of the antenna at the lower frequency. The feed patch member tail Sa acts as the radiating element at the higher frequencies. The gap shown in FIG. 22 between the further patch member 54 and the head 56*b* of feed patch member 56, which further patch member 54 surrounds on three sides, is critical; that gap provides an impedance match of the antenna to 50 ohms. That gap could be replaced by a discrete capacitor; the capacitor value will depend on the application and installation.

Figure 24:
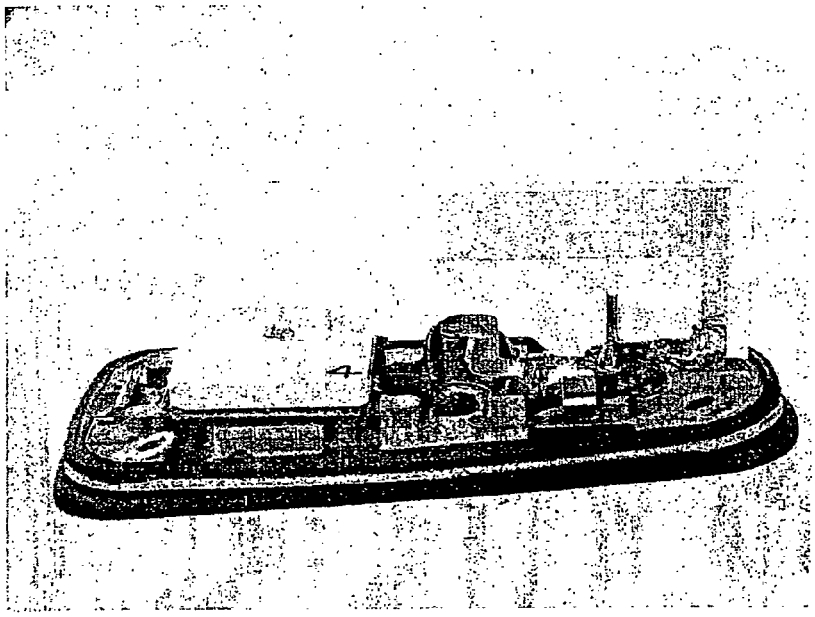
FIG. 24 illustrates the antenna of FIG. 22 in a proposed application as a roofmount antenna.
Figure 25:
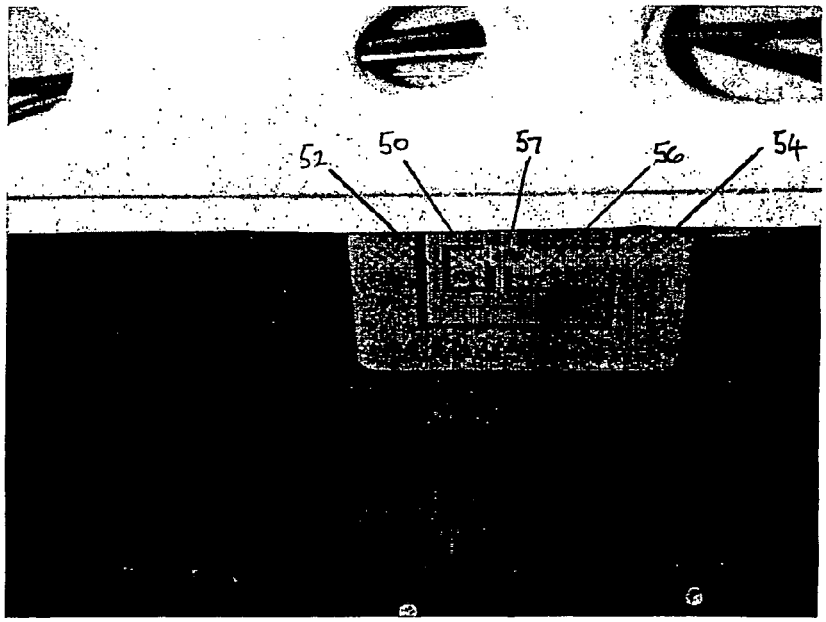
FIG. 25 illustrates the antenna of FIG. 22 in a proposed application as a windscreen antenna.

The design shown in FIG. 22 may be employed in many applications. Typical installation requires the grounded patch member 50 to be connected to a large metallic plate forming a ground plane. The connection could be in the form of a direct connection or capacitive coupling. Capacitive coupling requires the ground plate to be positioned near to the metal area. For optimum performance, the antenna can be installed on a vehicle roof so as to be mounted vertically; this arrangement, which is illustrated in FIG. 24, would normally be enclosed in a plastic cover. The antenna may be positioned proximate to a GPS antenna without any adverse effect on the latter. FIG. 25 illustrates the antenna of FIG. 22 when installed on the glass of a car windscreen; it may be installed on any form of glass, for instance, on a front or rear windscreen, or a side window. A cable is connected to the feed patch tail 56*a* at 57. For optimum performance, any cabling of the antenna should be routed close to the car bodywork; this avoids unwanted radiation from the cabling. Mounting the antenna on a vehicle bumper is also possible. In that case, the antenna can be produced on a standard printed circuit board material and be installed such that the grounded patch member 50 overlaps a metal reinforcement bar of the vehicle. It should be noted, however, that such low installation may result in antenna radiation being mainly directional at the lower frequencies. Other possible installation locations are: behind the rearview mirror, behind a side mirror, or even within a phone handset.

Figure 26:
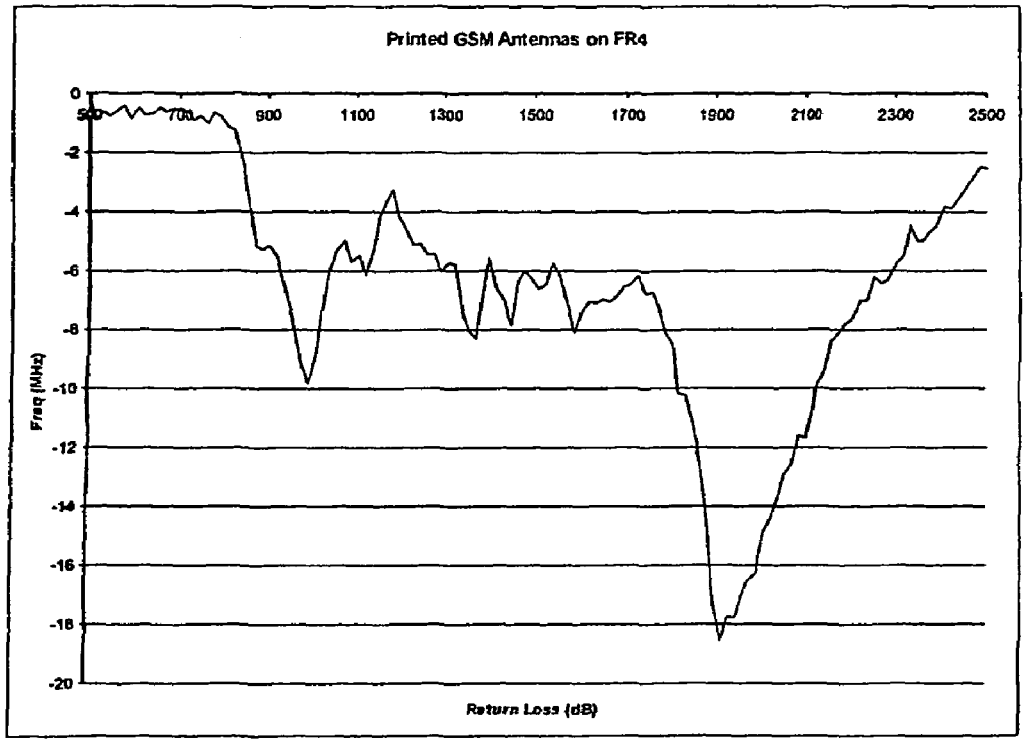
FIG. 26 is a return-loss measurement in freespace for the antenna of FIG. 22.
Figure 27:
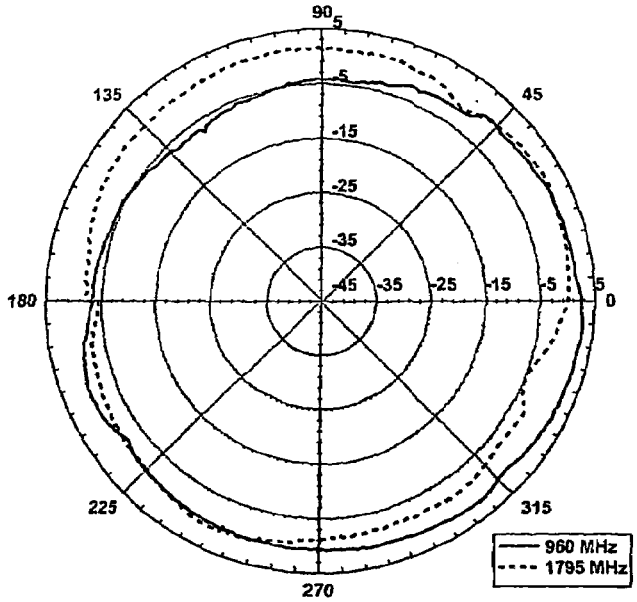
FIG. 27 are radiation pattern measurements in freespace for the antenna of FIG. 22, one radiation pattern being for a lower frequency of 960 MHz and one radiation pattern being for a higher frequency of 1795 MHz.
Figure 28:
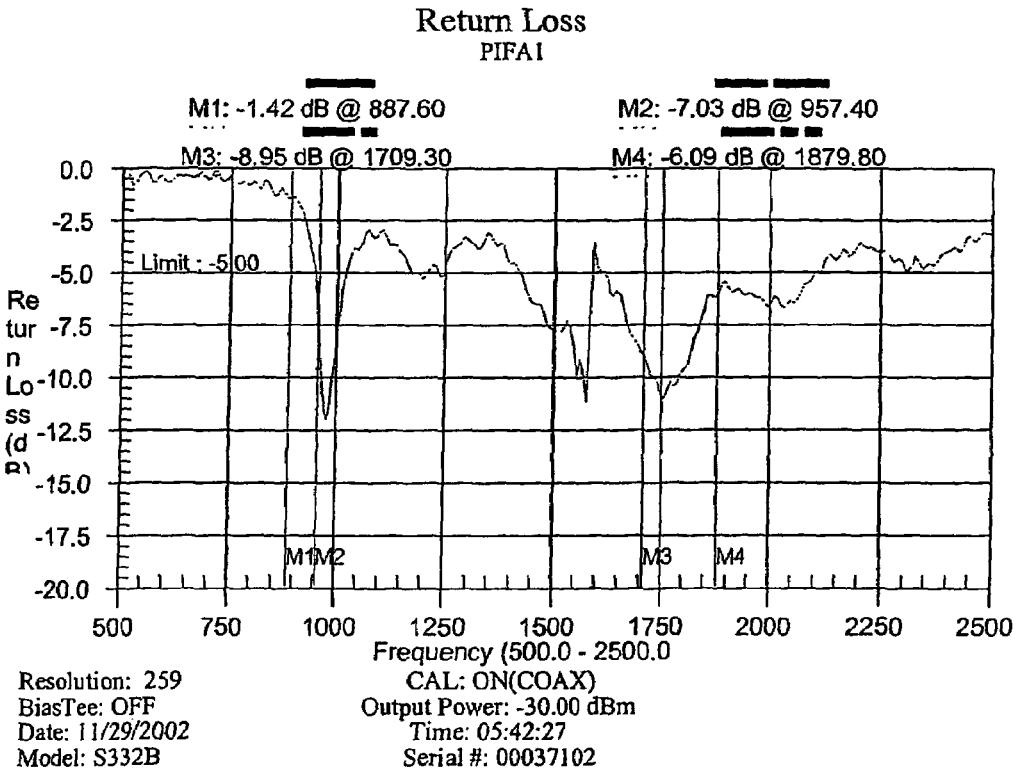
FIG. 28 is a return-loss measurement for the antenna of FIG. 22 when roof-mounted.
Figure 29:
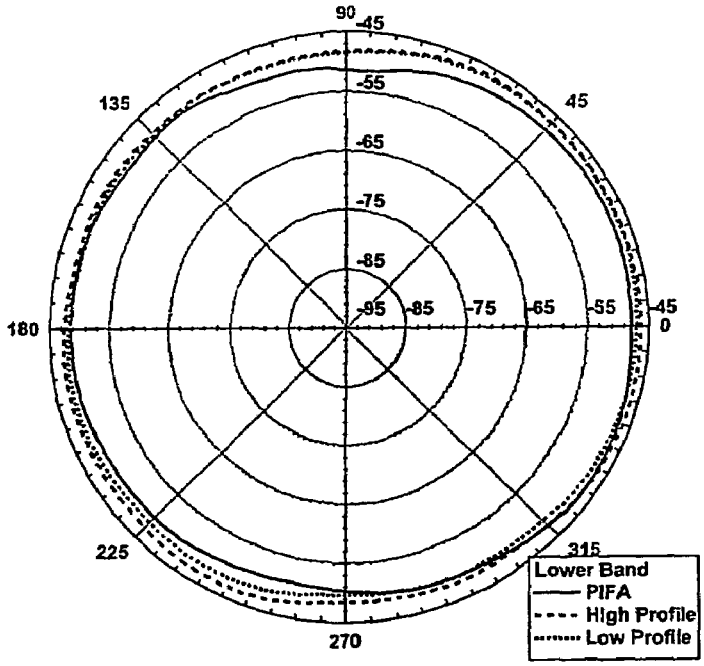
FIG. 29 is a radiation pattern measurement for lower band frequency for the antenna of FIG. 22 when roof-mounted.
Figure 30:
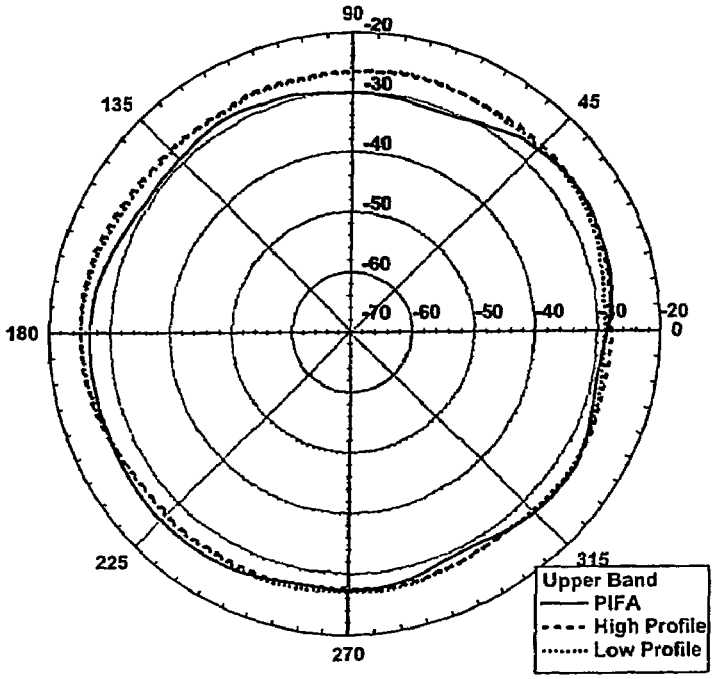
FIG. 30 is a radiation pattern measurement for upper band frequency for the antenna of FIG. 22 when roof-mounted.

FIG. 26 illustrates the return-loss measurement in free space for the antenna of FIG. 22, and FIG. 27 the azimuth radiation pattern at a lower frequency of 960 MHz and higher frequency of 1795 MHz (both measured in dBi) The graph in FIG. 28 illustrates return-loss results for a roof-mount installation of the antenna; to obtain these results, a large metal plate was used to represent a car roof. FIGS. 29 and 30 respectively represent radiation pattern measurements for lower and higher frequency bands for the roof-mount antenna.

Figure 31:
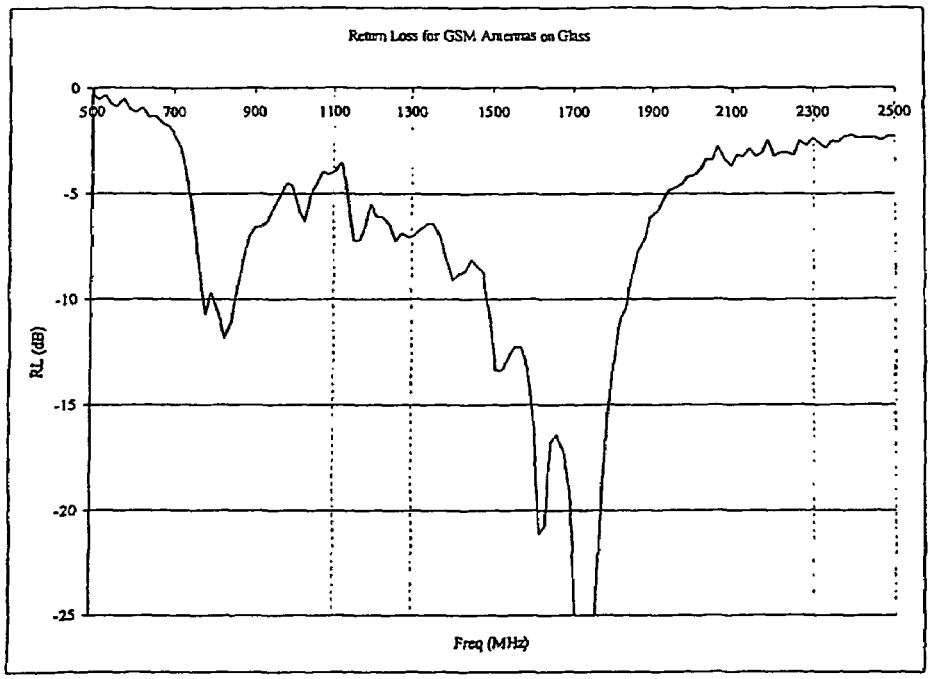
FIG. 31 is a return-loss measurement for the antenna of FIG. 22 when installed on a vehicle windscreen.
Figure 32:
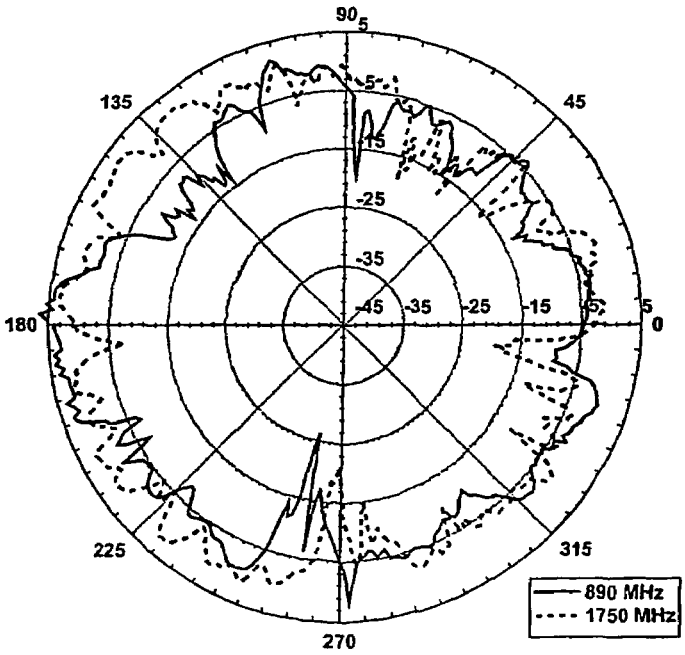
FIG. 32 are radiation pattern measurements for the antenna of FIG. 22 when installed on a vehicle windscreen, the lower frequency measurement being at 890 MHz and the upper frequency measurement being at 1750 MHz.

For optimum performance, the antenna is positioned a few millimetres off the glass; this is a characteristic of the glass rather than the antenna. At frequencies such as 1.8 GHz, the glass acts as a highly-lossy material, and positioning the antenna slightly away from the glass can reduce these losses. This is due to surface waves generated on the glass, which waves do not radiate and are loss in the material. FIG. 31 respectively illustrates return-loss measurement for an antenna placed slightly away from the glass of a vehicle windscreen, and FIG. 32 illustrates radiation patterns measured in dBi for that antenna (lower frequency of 890 MHz, and higher frequency of 1750 MHz).

Figure 33:
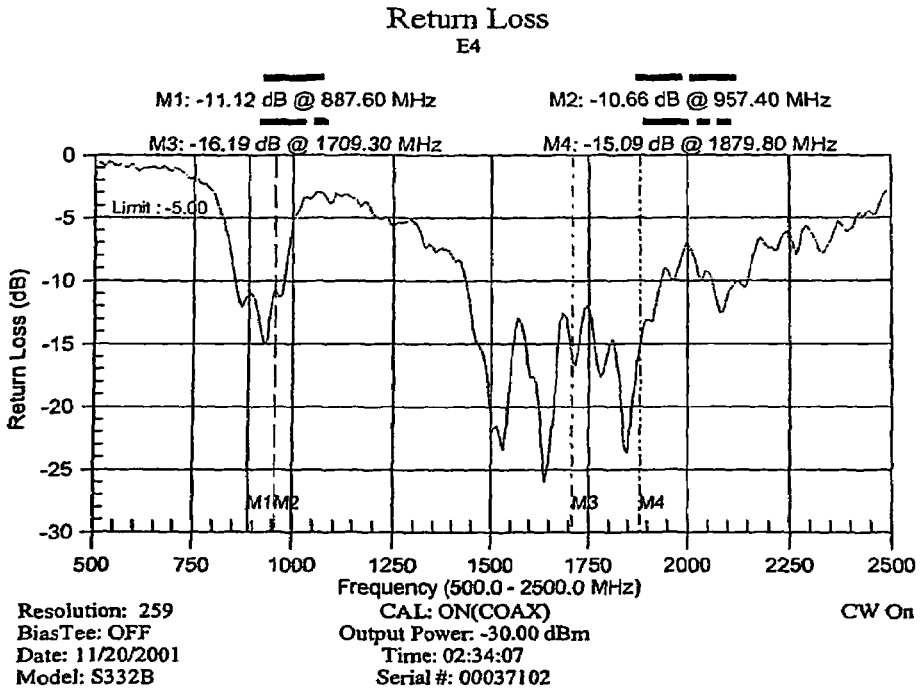
FIG. 33 is a return-loss measurement for the antenna of FIG. 22 when installed on a vehicle bumper.
Figure 34:
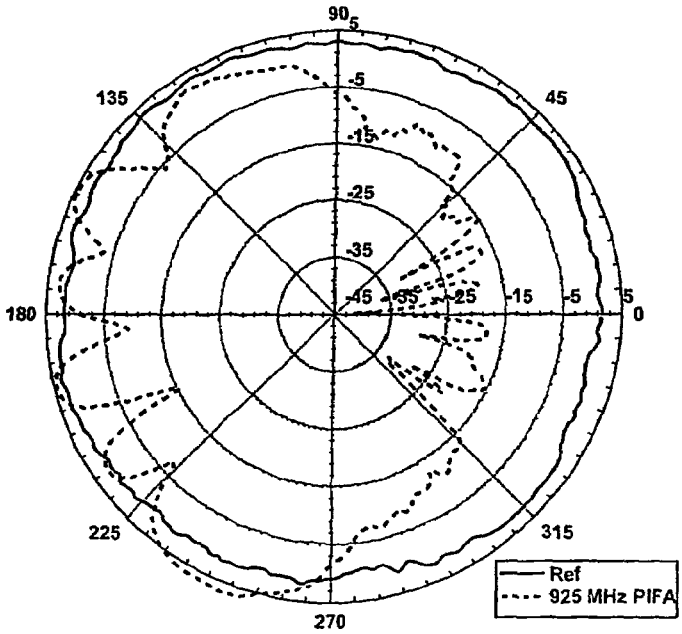
FIG. 34 are radiation pattern measurements for the antenna of FIG. 22 when installed on a vehicle bumper, the lower frequency measurement being at 925 MHz and the other measurement being at a reference frequency; and, FIG. 35 is a radiation pattern measurement for the antenna of FIG. 22 when installed on a vehicle bumper, the upper frequency measurement being at 1795 MHz and the other measurement being at the reference frequency.
Figure 35:
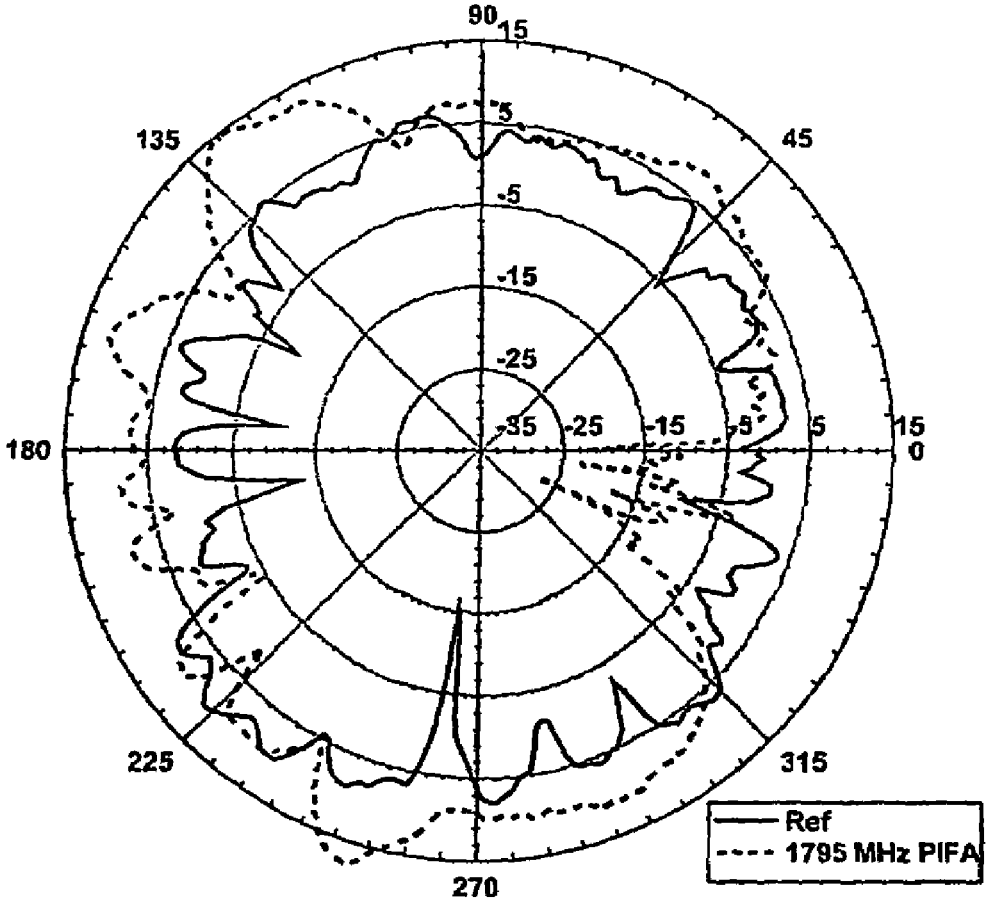

As mentioned above, the antenna can be installed on a vehicle bumper, either at the front or rear, or optimally at both the front. FIG. 33 illustrates the return-loss measurement for such an application, and FIGS. 34 and 35 illustrate corresponding radiation pattern measurements for a lower frequency of 925 MHz and an upper frequency of 1795 MHz, respectively.

Although the illustrated signal feed means in the antenna of FIG. 22 is the coaxial cable 60, a coupled-line feed may be used instead.

Figure 36:
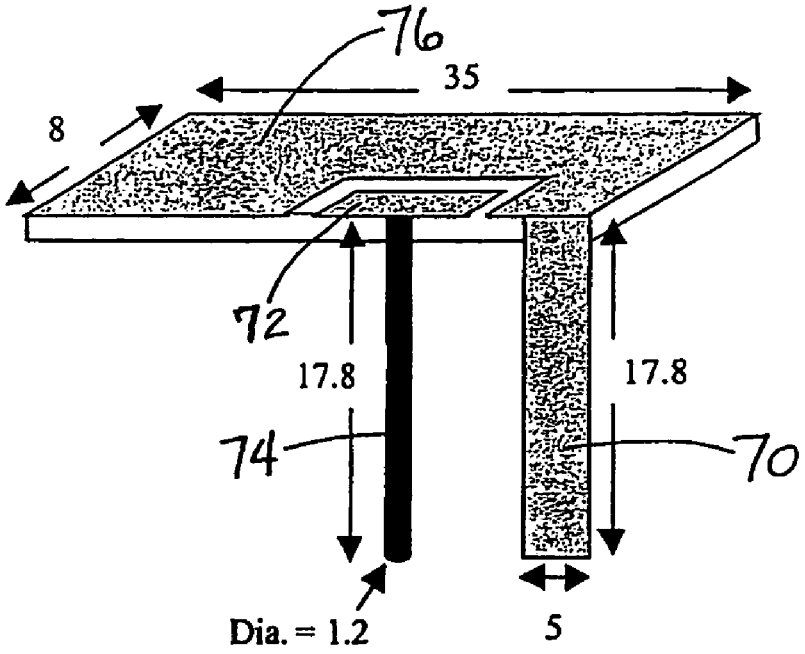
FIG. 36 is a perspective view of a eighth embodiment of the antenna of the subject invention, the embodiment being similar to the third embodiment shown in FIG. 4 and the fourth embodiment shown in FIG. 19; and, FIG. 37 is a plan view of the antenna of FIG. 36.
Figure 37:
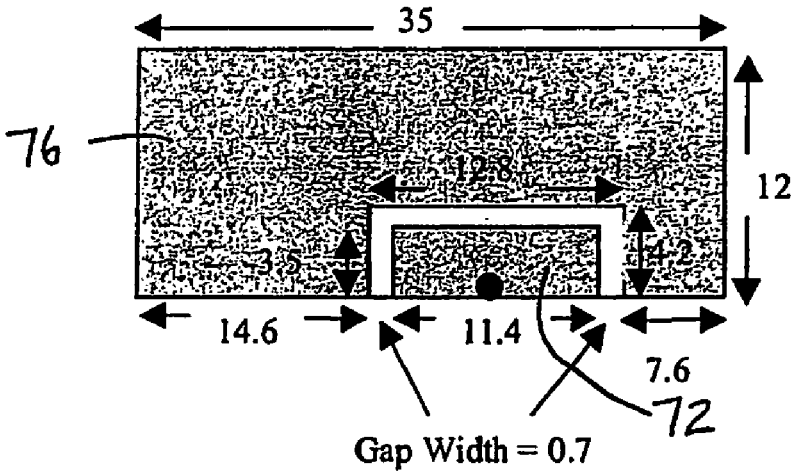

FIGS. 36 and 37 illustrate an eighth embodiment of the antenna of the invention. This embodiment is similar to the third embodiment of FIG. 4 and the fourth embodiment of FIG. 19, but varies in the relative positioning of the radiating element 70, the feed patch member 72, and the feed pin 74, and in the position of those elements relative to the further patch member 76. The dimensions shown in FIGS. 36 and 37 are in millimetres.

While the present invention has been described in its preferred embodiments, it is to be understood that the words which have been used are words of description rather than limitation, and that changes may be made to the invention without departing from its scope as defined by the appended claims.

Each feature disclosed in this specification (which term includes the claims) and/or shown in the drawings may be incorporated in the invention independently of other disclosed and/or illustrated features.

The text of the abstract filed herewith is repeated here as part of the specification.

A high-bandwidth multi-band antenna includes a ground plane member, a first patch member extending in generally-parallel spaced relationship with the ground plane member and electrically connected thereto, and a second patch member connectable to a signal feedline and extending generally coplanar with the first patch member within a slot formed in the first patch member. The second patch member is formed integral with a vertical conductive connecting member as part of a folded conducting plate; this construction allows the second patch member to be quickly and accurately positioned relative to the ground plane member before attachment to the ground plane member. The antenna has the advantages of a high bandwidth, simple construction and inexpensive manufacture.

The invention claimed is:

1. A high-bandwidth multi-band antenna comprising a grounded patch member, a further patch member extending in generally-parallel spaced relationship with the grounded patch member and being electrically connected thereto, and a feed means adapted to carry a feedline signal, the feed means terminating at a termination that is generally coplanar with the further patch member and occupies part of a void space in the further patch member, a slot being thereby defined between the further patch member and the termination, the further patch member and the termination being capacitively coupled across the slot.

2. The antenna as described in claim 1, wherein the termination is a feed patch member, and wherein dimensions of the feed patch member and the width of the slot are selected such that each is within a respective range in which the bandwidth of the antenna varies with the slot width.

3. The antenna as described in claim 2, wherein the grounded patch member, the further patch member and the feed patch member are each formed as a conductive surface on a dielectric support.

4. The antenna as described in claim 2, wherein the further patch member and feed patch member both have a rectangular shape with longer first edges of each being oriented in the same direction.

5. The antenna as described in claim 4, wherein a frequency bandwidth for a higher one of the resonant frequencies of the antenna increases with a reduction in the length of the further patch member.

6. The antenna as described in claim 4, wherein a lowest resonant frequency of the antenna decreases with a reduction in the length of the further patch member.

7. The antenna as described in claim 2, and also comprising a radiating element connecting a portion of an edge of the grounded patch member to a portion of an edge of the further patch member such that the grounded patch member, radiating element and further patch member form a generally U-shaped configuration, wherein the grounded patch member, further patch member, feed patch member and radiating element all extend in the same plane.

8. The antenna as described in claim 7, and also comprising a feedline patch member connected to the feed patch member, the feedline patch member extending generally parallel to the radiating element and toward the grounded patch member in the plane of the further patch member, feed patch member and radiating element.

9. The antenna as described in claim 8, wherein the grounded patch member, further patch member, feed patch member, feedline patch member and radiating element are each formed as a conductive surface on a dielectric support.

10. The antenna as described in claim 1, and also comprising a discrete capacitor connected between the termination and the further patch member.

11. The antenna as described in claim 2, wherein the further patch member is electrically connected to the grounded patch member by a radiating element extending between the grounded patch member and one first edge of the further patch member.

12. The antenna as described in claim 11, wherein a first edge of the radiating element is connected to the one first edge of the further patch member.

13. The antenna as described in claim 11, wherein the feed patch member extends inwardly from an unconnected portion of the one first edge of the further patch member.

14. The antenna as described in claim 11, wherein the further patch member and the radiating element are integrally formed from a conductive sheet and separated by a fold-line in the sheet.

15. The antema as described in claim 14, and also comprising a solid dielectric material extending in the space that separates the grounded patch member from the further patch member and the feed patch member.

16. The antenna as described in claim 11, wherein the resonant frequencies of the antenna increase with an increase in the width of the radiating element.

17. The antenna as described in claim 11, wherein the radiating element is comprised of a series of parallel strips, each strip extending between the grounded patch member and the one first edge of the further patch member.

18. The antenna as described in claim 1, wherein the antenna operates in a first band in the range of 900 MHz and in a second band in the range of 1800 MHz.

19. The antenna as described in claim 18, wherein the antenna also operates in a third band in the range of 2200 MHz.

* * * * *